US008858347B1

(12) United States Patent
Gesner

(10) Patent No.: US 8,858,347 B1
(45) Date of Patent: Oct. 14, 2014

(54) GRADIENT-ADJUSTABLE SKATE PARK SYSTEM AND METHODS FOR USING THE SAME

(75) Inventor: Eli Morgan Gesner, New York, NY (US)

(73) Assignee: NTSL, LLC, New York, NY (US)

( * ) Notice: Subject to any disclaimer, the term of this patent is extended or adjusted under 35 U.S.C. 154(b) by 81 days.

(21) Appl. No.: 13/344,573

(22) Filed: Jan. 5, 2012

Related U.S. Application Data

(60) Provisional application No. 61/430,066, filed on Jan. 5, 2011.

(51) Int. Cl.
*A63C 19/00* (2006.01)

(52) U.S. Cl.
USPC ..... 472/89; 472/92

(58) Field of Classification Search
USPC ..... 472/89, 92
See application file for complete search history.

(56) References Cited

U.S. PATENT DOCUMENTS

| | | | | |
|---|---|---|---|---|
| 6,923,746 | B1 * | 8/2005 | Skowronski et al. | 482/54 |
| 2009/0286609 | A1 * | 11/2009 | Dyrdek | 472/89 |
| 2011/0014844 | A1 * | 1/2011 | Henson et al. | 446/85 |
| 2011/0060550 | A1 * | 3/2011 | Vock et al. | 702/141 |

* cited by examiner

*Primary Examiner* — Michael Dennis
(74) *Attorney, Agent, or Firm* — Byrne Poh LLP

(57) ABSTRACT

A gradient-adjustable skate park system and methods for using the same are provided. In accordance with some embodiments, a skate park system comprises a plurality of structures, wherein each structure of the plurality of structures includes one or more features for allowing a skateboarder to perform at least one skateboarding trick, a plurality of raising mechanisms coupled beneath at least a portion of the plurality of structures, and a processor that is configured to control the plurality of raising mechanisms to decline the plurality of structures by a predetermined angle.

11 Claims, 9 Drawing Sheets

GRADIENT-ADJUSTABLE SKATE PARK SYSTEM AND METHODS FOR USING THE SAME

CROSS-REFERENCE TO RELATED APPLICATIONS

This application claims the benefit of U.S. Provisional Patent Application No. 61/430,066, filed Jan. 5, 2011, which is hereby incorporated by reference herein in its entirety.

FIELD OF THE INVENTION

The present invention relates to a gradient-adjustable skate park system and methods for using the same.

BACKGROUND

Skateboarding, whether recreational skateboarding or competitive skateboarding, involves a skateboarder riding on a skateboard and performing one or more tricks using the skateboard. Skateboarding is one of the fastest growing sports that already has over 20 million skateboarders worldwide and, more particularly, is the third most popular high school sport behind basketball and football. Currently, there are over 1,800 skate parks in the United States, which has significantly increased from about 200 skate parks in 1996.

However, while skateboarding has become a professional sport (e.g., in part due to the X-Games, the Dew Tour, the Maloof Money Cup, etc.), competitive skateboarding remains a difficult sport to watch for the casual viewer. Oftentimes, the casual viewer does not understand the subjective scoring system that one or more judges award to particular riders/competitors. More particularly, both the casual viewer and the rider/competitor have little understanding as to scores that can be achieved for performing particular tricks or combinations of tricks.

Furthermore, competitive skateboarding may have reached a saturation point. The competitive formats in skateboarding provide a non-exciting event that lends itself to a rider performing a repetitive trick or a combination or tricks. In addition, current formats lead to a rider only skateboarding and performing tricks to his or her strengths and/or capabilities. For example, a rider that is not known to ride switch-stance performs a trick or a combination of tricks riding switch-stance and, as a result, the one or more judges acknowledge this and award a higher score to the rider than if the rider performed the trick riding in a regular stance. This is also lost on the casual viewer.

Accordingly, there is a need in the art for approaches that overcome these and other deficiencies of the prior art.

SUMMARY OF THE INVENTION

In view of the foregoing, a gradient-adjustable skate park system and methods for using the same are provided. In some embodiments, a skate park system can include structures, where each of these structures can include one or more features (e.g., any suitable number of curbs, ledges, sets of stairs, handrails, sidewalks, driveway bumps, fences, walls, embankments, planters, benches, picnic tables, manholes, pipes, and/or ramps) that allow a skateboarder to perform one or more skateboarding tricks.

In some embodiments, the structures are modular structures that can be interconnected with other structures to form the skate park. For example, a customized skate park can be assembled with particular structures.

In some embodiments, the gradient of the skate park can be adjusted, where at least a portion of the structures in the skate park can be inclined or declined over a predefined period of time. Using a plurality of raising mechanisms coupled beneath at least a portion of the plurality of structures, at least a portion of the structures can be inclined or declined by a predetermined angle or degree. For example, at the start of a skateboarding competition, the skate park and its structures can be configured to have a gradient or an incline angle of zero or substantially zero degrees (a relatively flat skate park). As the skateboarding competition progresses, the plurality of raising mechanisms can be used to change the incline or decline angle of the skate park. In a more particular example, as each round concludes, the plurality of raising mechanisms can be used to raise or lower one end of the skate park, thereby modifying the amount of incline (e.g., zero degrees, three degrees, ten degrees, negative three degrees, negative ten degrees, etc.) and increasing the difficulty of the skate park.

Moreover, in some embodiments, the skateboarding competition can include a scoring rule where placing your foot down off the skateboard eliminates the rider from the competition (e.g., an out). Between each round of the skateboard competition, the plurality of raising mechanisms can be used to raise or lower one end of the skate park to create a downhill skate park, where the difficulty of the skate park increases with the gradient or slope of the skate park and where riders continue to be prohibited from placing a foot off the skateboard and onto the ground of the skate park.

In a more particular embodiment, the skate park can be inclined or declined with the use of mechanical mechanisms that raise or lower one end of the skate park in comparison with the opposing end. Mechanical raising mechanisms, such as scissor-type lifts, placed in particular locations beneath portions of the skate park can be used to incline or decline the skate park from a horizontal or level position to multiple declined positions (e.g., five degrees, ten degrees, twenty degrees, thirty degrees, etc.). It should be noted that, in order to decline the skate park by a particular number of degrees, the raising mechanism (e.g., the scissor-type lifts placed beneath particular structures) can be configured to raise or lower different distances along different structures of the skate park. For example, a raising mechanism placed beneath a first portion of the skate park may be raised a first particular distance, while a raising mechanism placed beneath a second portion of the skate park may be raised a second particular distance (which is less than the first particular distance). In another example, a raising mechanism placed beneath one end of the skate park may control the incline of the entire skate park and other raising mechanisms placed under other portions of the skate park may be raised or lowered particular distances to support the gradient or angle of the skate park.

In some embodiments, the raising mechanism (e.g., the scissor-type lifts placed beneath particular structures) can be configured to lock the skate park or portions of the skate park at particular levels. For example, when the structures are modular structures interconnected to form the skate park, the raising mechanism connected to a first modular structure at one end of the skate park can raise or lower the structure a first distance from the ground to decline the skate park at a first angle and a second distance to decline the skate park at a second angle. In a more particular example, the raising mechanism can be configured to raise ten feet for every additional degree of decline. In another more particular example, the skate park can be constructed with raising mechanisms to create an elevated platform and the raising mechanisms can be configured to lower a particular amount, thereby modifying the decline angle of the skate park. In yet another more particular example, the skate park can be constructed with raising mechanisms that are configured to raise ten feet to incline the skate park.

Alternatively, in some embodiments, the raising or inclining mechanisms can incline or decline one or more structures of the skate park. For example, when the structures are modular structures interconnected to form the skate park, a first set of raising mechanisms can decline a first set of structures of the modular skate park (e.g., including a set of stairs) at a first predetermined number of degrees (e.g., three degrees) and a second set of raising mechanisms can incline a second set of structures of the modular skate park (e.g., including a ramp) at a second predetermined number of degrees (e.g., ten degrees).

It should be noted that, although the raising or inclining mechanisms are generally described herein as mechanical mechanisms or mechanical devices, this is merely illustrative. Any suitable raising mechanisms can be used, such as, for example, electrical, hydraulic, and/or pneumatic. In a particular example, the raising mechanisms can receive a signal from a computing device to hydraulically hoist the skate park from one end of the skate park about ten feet from the ground, thereby creating a decline or incline of a particular number of degrees.

It should also be noted that, although the inclining mechanisms are generally described herein as mechanical mechanisms that raise the skate park from a flat position, this is merely illustrative. For example, the skate park can be constructed on a plurality of raising mechanisms, where the plurality of raising mechanisms are inclined to the same height or position to create a skate park on an elevated platform. At a predetermined time, the position of some of the plurality of raising mechanisms can be lowered to decline the skate park.

BRIEF DESCRIPTION OF THE DRAWINGS

Various objects, features, and advantages of the disclosed subject matter can be more fully appreciated with reference to the following detailed description of the invention when considered in connection with the following drawing, in which like reference numerals identify like elements.

DETAILED DESCRIPTION

Figure 1A:
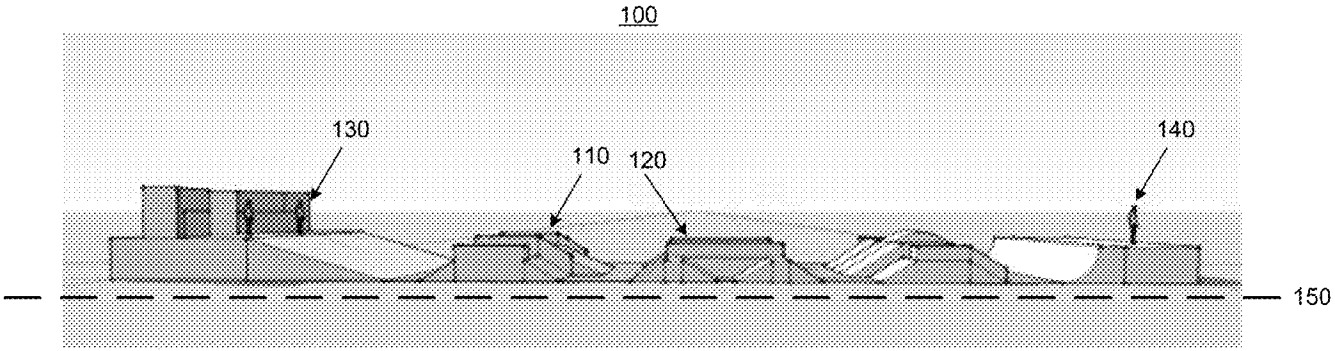
FIG. 1A shows an illustrative example of a skate park system with multiple structures that have been interconnected, where each of the structures includes various features for performing skateboarding tricks, in accordance with some embodiments of the disclosed subject matter.

In accordance with some embodiments, a configurable skate park system and methods for using the same are provided. In particular, a skate park system can include structures, where each of these structures can include one or more features (e.g., any suitable number of curbs, ledges, sets of stairs, handrails, sidewalks, driveway bumps, fences, walls, embankments, planters, benches, picnic tables, manholes, pipes, and/or ramps) that allow a skateboarder to perform one or more skateboarding tricks. For example, as shown in FIG. 1A, a skate park system 100 can include structures 110 and 120, where each structure includes different features for allowing a skateboarder to perform one or more skateboarding tricks. In a more particular example, structure 110 can include a ramp, a set of stairs with handrails, and a planter, while structure 120 can include three different ramps.

It should be noted that, in some embodiments, each of the features or components within structure 110 or 120 can be a modular structure. For example, the ramp, the set of stairs with handrails, and the planter in structure 110 can be three modular structures that can be interchanged. In a more particular example, the modular structures can be removed and/or replaced during a skateboarding competition.

In some embodiments, each of these structures can be interconnected with other structures to form the skate park. For example, as shown in FIG. 1A, structures 110, 120, and other structures can be assembled to form the skate park. In a more particular example, structure 110 and/or structure 120 can include a connection mechanism, such as interlocking fastening elements or anchoring elements. In another more particular example, the components of structure 110 can be connected using connection mechanisms to form a drop portion or a hit portion of the skate park.

In a more particular embodiment, modular structures can be selected and assembled to create skate parks that reflect and/or simulate local skateboarding environments. For example, modular structures containing palm trees and concrete half pipes can be assembled to simulate skate parks found in Miami. In another example, a New York skate park can be assembled with modular structures containing stairs and handrails similar to those that are prevalent in the New York area. In yet another example, to not provide an advantage to any particular rider, a skate park can be assembled that integrates modular structures and features from multiple environments.

In a more particular embodiment, modular structures can be selected and assembled to create different skate parks during a skateboarding competition. For example, modular structures containing palm trees and concrete half pipes can be assembled to simulate features found in Miami skate parks in one round of a competition, while features found in a New York skate park can be integrated into the skate park in a second round of the competition.

Alternatively, the skate park, such as the one shown in FIG. 1A, can be constructed to reflect and/or simulate a local skateboarding environment without the use of modular, interchangeable structures.

Referring back to FIG. 1A, from the perspectives of rider 130 and rider 140, skate park 100 appears generally flat. For example, FIG. 1A shows an orientation line 150 indicating that a skateboard competition can begin where configurable skate park 100 is provided with no or substantially no incline (e.g., a zero degree incline angle). In another example, skate park 100 can be constructed on an elevated platform with raising mechanisms, where the elevated platform can be provided with no or substantially no incline and where the raising mechanisms can be used to decline the elevated platform.

Figure 1B:
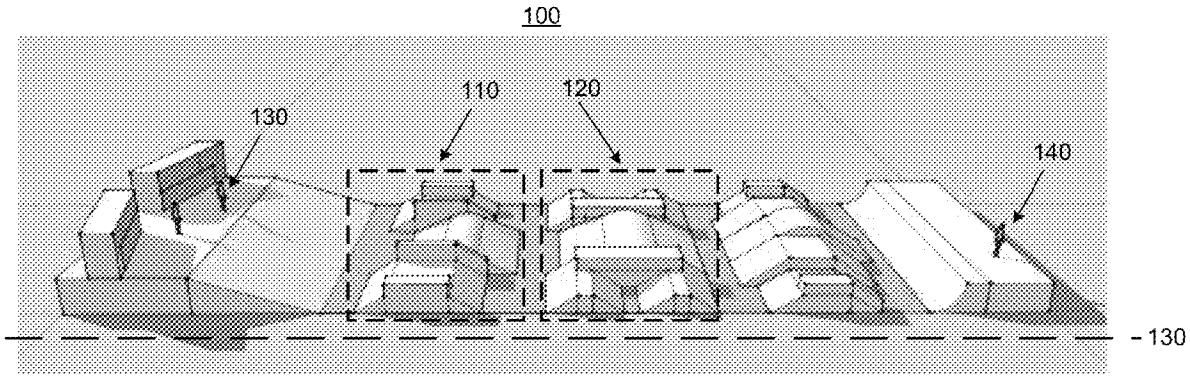
FIGS. 1B and 1C show alternative prospective views of the skate park system shown in FIG. 1A in accordance with some embodiments of the disclosed subject matter.
Figure 1C:
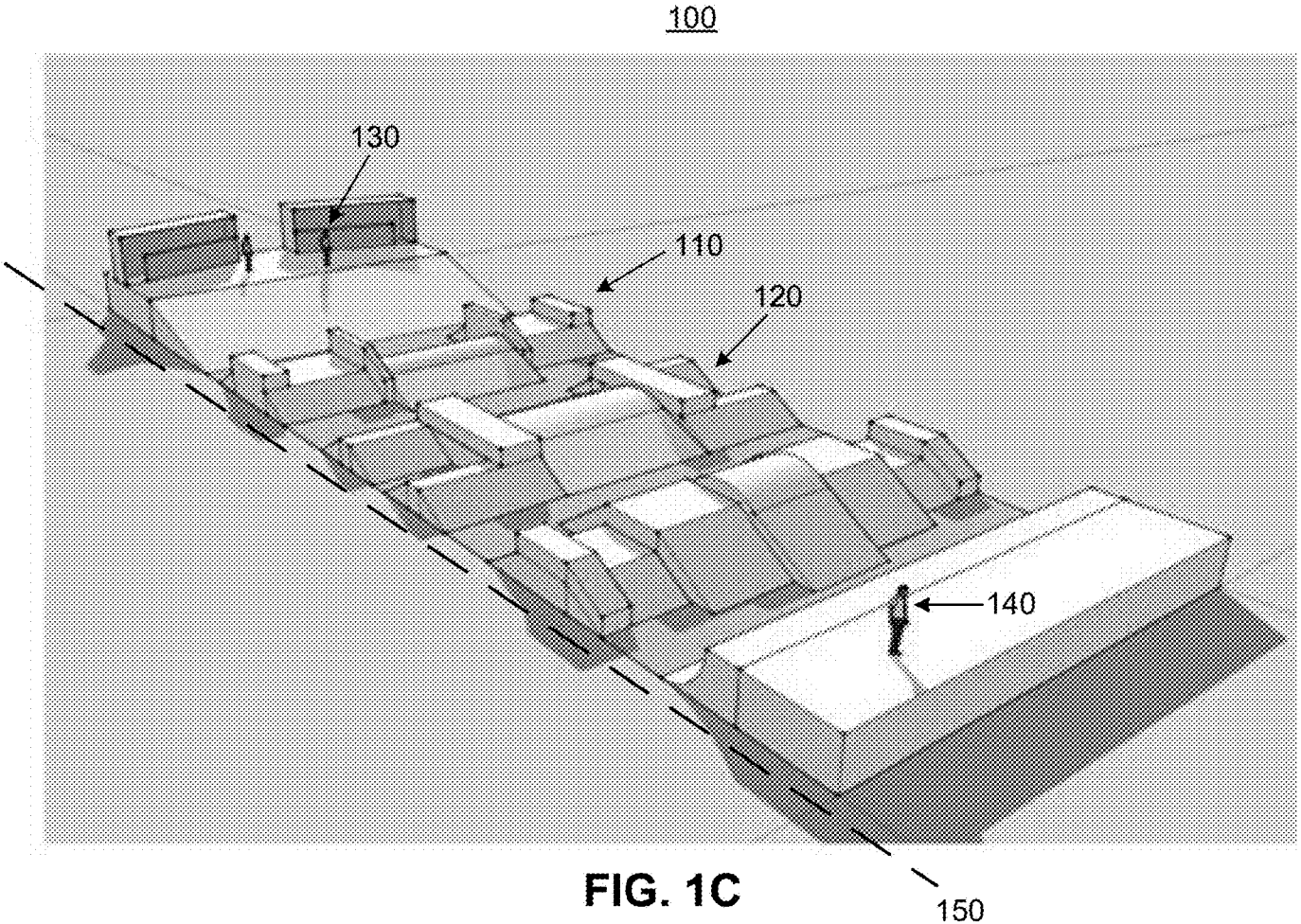

FIGS. 1B and 1C show different perspective views of skate park 100 shown in FIG. 1A. For example, FIG. 1C shows skate park 100 from the perspective of rider 140.

Over time, the incline or gradient of the skate park can be configured such that the skate park 100 can be lowered or raised a particular number of degrees—e.g., five degrees every round of a skateboarding competition. As shown in FIGS. 2A-2C and 3A-3C, riding in skate park 100 and/or a skateboarding competition in skate park 100 can change with respect to speed, difficulty level, and strategy as the incline or decline angle of skate park 100 increases. For example, the overall speed of the park is modified as the rider faces a downhill-oriented park and its structures. In another example, a rider approaching the uniquely arranged structures of the park alters his or her strategy to account for the inclined condition. In a more particular example, a first round of a competition can be timed where the rider can repeatedly return to a portion of skate park 100, while a later round of the competition can have an incline angle such that the rider cannot return to a previously visited portion of skate park 100 due to its slope. In yet another example, upon a rider becoming skilled at a particular portion of skate park 100, the difficulty of that portion can be increased by increasing the incline angle of that portion (e.g., providing a steeper downhill slope).

As shown in FIGS. 2A-2C and 3A-3C, a plurality of raising mechanisms 160 can be provided beneath at least a portion of the plurality of structures to incline or decline the portion of skate park 100 or the entire skate park 100 by a predetermined angle or degree. For example, as shown in FIGS. 2A-2C and 3A-3C, the plurality of raising mechanisms 160 are placed beneath the skate park 100 and around the periphery of the base or platform of skate park 100. However, the plurality of raising mechanisms 160 can be placed in any suitable location such that skate park 100 is inclined or declined a particular number of degrees.

In an example where skate park 100 is used during a skateboarding competition, as shown in FIGS. 1A-1C, at the start of a skateboarding competition, the skate park and its structures (e.g., structures 110 and 120) can be configured to have an incline of zero or substantially zero degrees (a relatively flat skate park). As the skateboarding competition progresses in FIGS. 2A-2C and 3A-3C, plurality of raising mechanisms 160 can be used to change the incline of skate park 100. In a more particular example, as each round concludes, the plurality of raising mechanisms can be used to raise or lower one end of the skate park, thereby modifying the amount of incline (e.g., zero degrees, three degrees, ten degrees, etc.) and increasing the difficulty of the skate park.

In a more particular embodiment, the skate park can be inclined or declined with the use of mechanical mechanisms 160 that raise one end of the skate park higher than the other. Mechanical raising mechanisms 160, such as scissor-type lifts, placed in particular locations beneath portions of the skate park 100 can be used to incline the skate park from a horizontal or level position to multiple inclined positions (e.g., five degrees, ten degrees, twenty degrees, thirty degrees, etc.). It should be noted that, in order to incline the skate park 100 by a particular number of degrees, raising mechanism 160 (e.g., the scissor-type lifts placed beneath particular structures) can be configured to raise different distances along different structures of the skate park. For example, a raising mechanism placed beneath a first portion of the skate park may be raised a first particular distance, while a raising mechanism placed beneath a second portion of the skate park may be raised a second particular distance (which is less than the first particular distance). In another example, a raising mechanism placed beneath one end of the skate park may control the incline or decline of the entire skate park and other raising mechanisms placed under other portions of the skate park may be raised particular distances to support the gradient of the skate park.

In another more particular embodiment, the skate park can be declined with the use of mechanical mechanisms 160 that lower one end of the skate park than the opposing end. The skate park can be formed on mechanical mechanisms 160 to create a skate park on an elevated platform. Mechanical mechanisms 160, such as scissor-type lifts, placed in particular locations beneath the skate park 100 can be used to decline the skate park from a horizontal or level position to multiple predetermined angles. For example, a mechanical mechanism placed beneath a first portion of the skate park may be lowered a first particular distance, while a mechanical mechanism placed beneath a second portion of the skate park may be lowered a second particular distance (which is more than the first particular distance). Creating a downhill skate park can increase the difficulty of the skate park especially when competition rules include a prohibition of placing a rider's foot on the ground of the skate park.

It should be noted that raising mechanisms 160 can be placed in any suitable arrangement to achieve the desired incline or decline. For example, as shown in FIGS. 2A-2C and 3A-3C, raising mechanisms 160 can be placed at predetermined locations (e.g., every ten feet) beneath the skate park 100. Alternatively, the raising mechanisms can be placed at the ends of the skate park 100.

It should also be noted that, although the embodiments described herein generally illustrate that the skate park 100 is inclinable and declinable such that one end of the park is raised or lowered with respect to the opposite end of the park, this is merely illustrative. For example, when the structures of skate park 100 are modular structures, the plurality of raising mechanisms 160 can be placed throughout the modular skate park 100, thereby modifying particular modular structures and features of the park. For example, a flat area can be angled or raised to become a table top or an embankment. In another example, a thirty degree ramp can be raised with one or more of the raising mechanisms 160 to become a forty degree ramp. In another example, a thirty degree ramp can be lowered with one or more of the raising mechanisms 160 to become a twenty degree ramp.

It should further be noted that, although the embodiments described herein generally illustrate that the raising mechanisms 160 are placed to incline or decline the skate park 100 at one end of the course, either end of the skate park can be raised or lowered or both ends of the skate park can be raised or lowered. For example, raising mechanisms 160 can be placed at one end of the skate park 100 to increase the slope of the drop portion for a rider entering the course, while raising mechanisms 160 can be placed at the opposite end of the skate park 100 to increase the difficulty of reaching the final drop or kill drop portion for allowing the rider to enter a score for the course. In another example, raising mechanisms 160 can be placed at one end of the skate park 100 to increase the slope of the drop portion for a rider entering the course, while raising mechanisms 160 can be placed at the opposing end of the skate park 100 that further lowers the opposing end to further increase the slope of the skate park 100.

In another suitable embodiment, additionally or alternatively to raising or lowering one end of the skate park with respect to the opposing end of the skate park, some raising mechanisms can be raised or lowered with respect to other raising mechanisms to tilt the skate park. For example, the skate park can be tilted to the left to create an angled or tilted planter. In another example, the skate park can be adjusted to be a downhill skate park with features that are also tilted to the right to create different features for performing skateboarding tricks. This can, for example, force the rider to perform particular tricks on particular features.

Figure 2A:
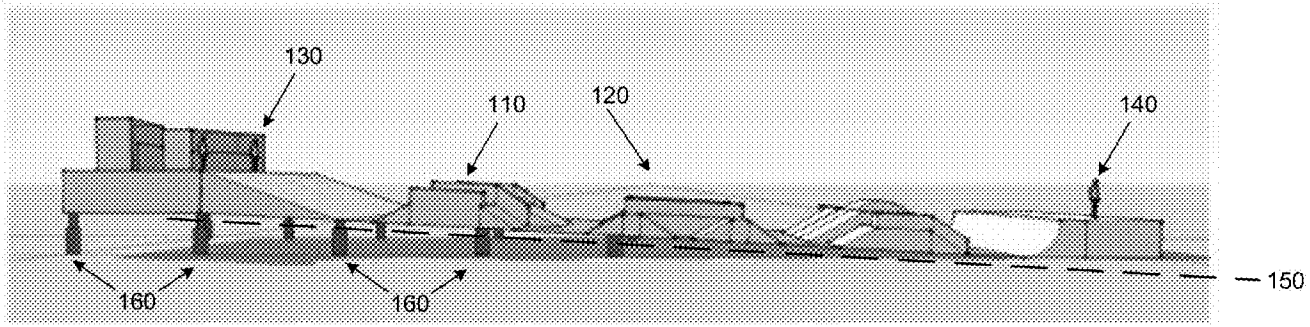
FIG. 2A shows an illustrative example of the skate park system shown in FIG. 1A with raising mechanisms that have declined the skate park at a first particular angle in accordance with some embodiments of the disclosed subject matter.
Figure 2B:
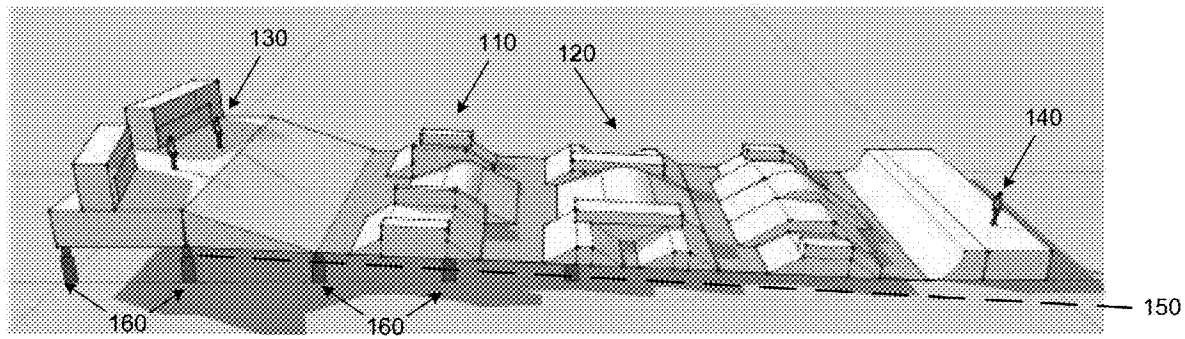
FIGS. 2B and 2C show alternative prospective views of the skate park system shown in FIG. 2A in accordance with some embodiments of the disclosed subject matter.
Figure 2C:
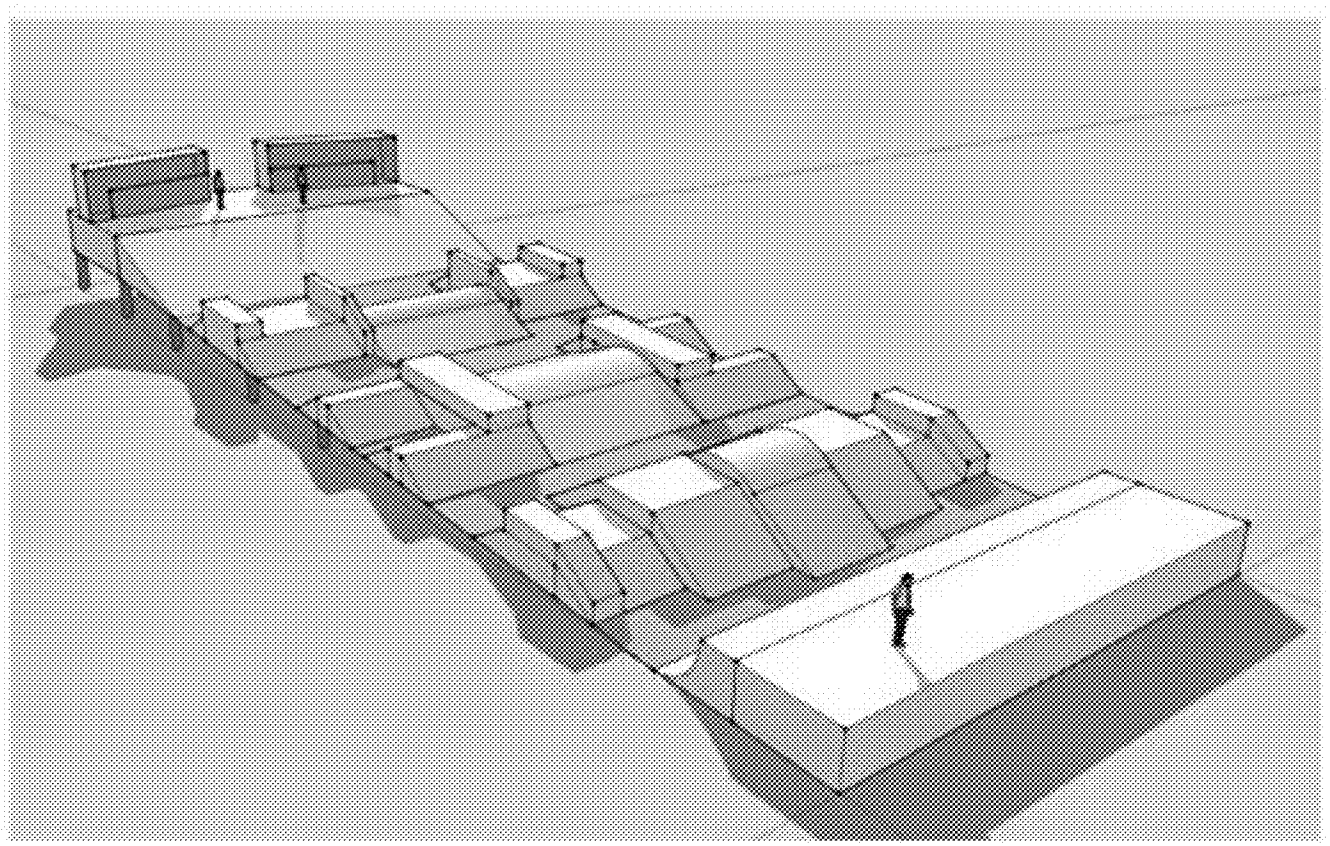
Figure 3A:
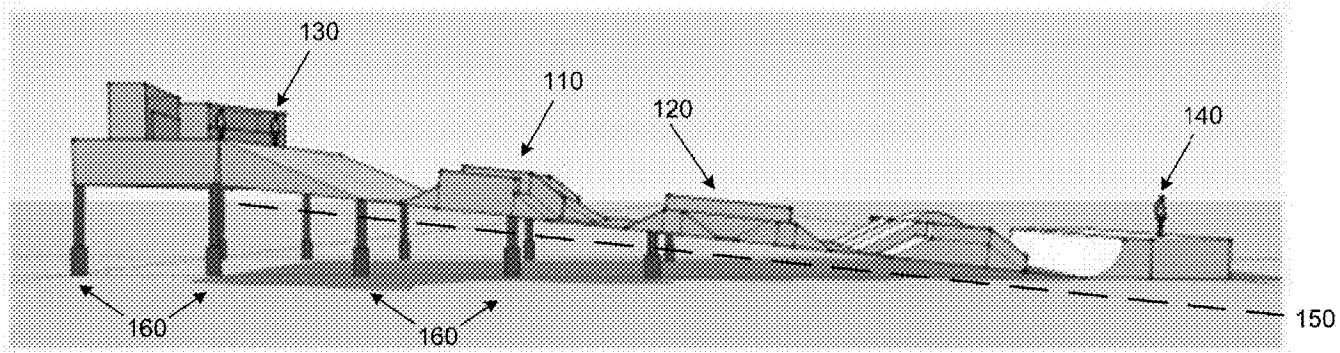
FIG. 3A shows an illustrative example of the skate park system shown in FIG. 2A with raising mechanisms that have declined the skate park at a second particular angle in accordance with some embodiments of the disclosed subject matter.
Figure 3B:
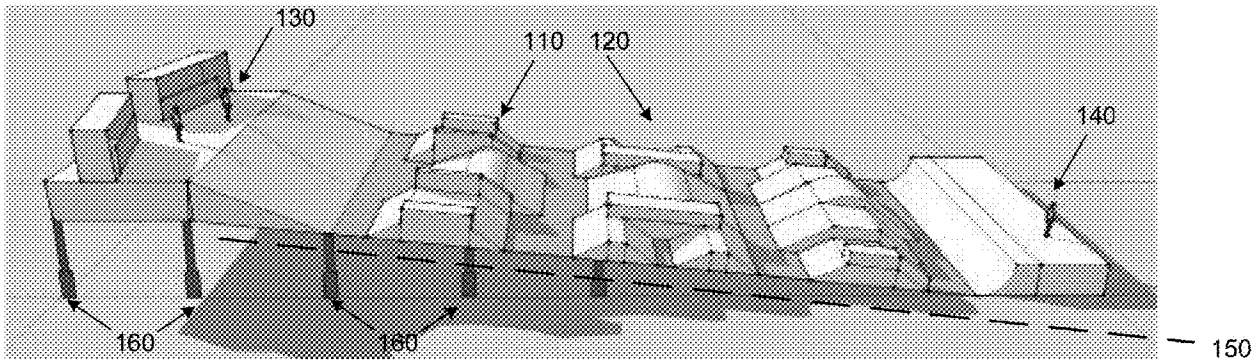
FIGS. 3B and 3C show alternative prospective views of the skate park system shown in FIG. 3A in accordance with some embodiments of the disclosed subject matter.
Figure 3C:
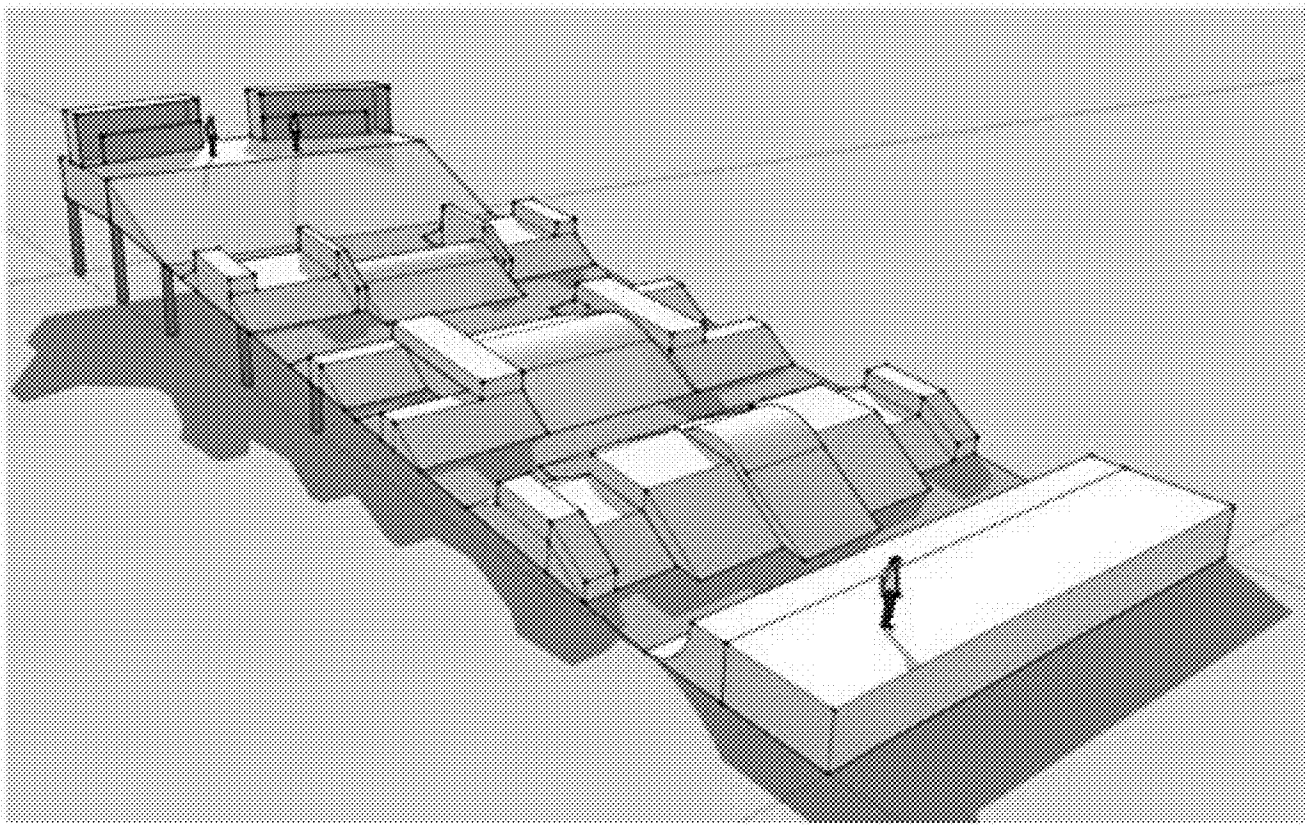

In some embodiments, the raising mechanism (e.g., the scissor-type lifts placed beneath particular structures) can be configured to lock the skate park or portions of the skate park at particular levels. For example, as shown in FIGS. 2A-2C, the raising mechanisms 160 connected to a first structure at one end of the skate park can raise or lower the structure a first distance to decline the skate park at a first angle (illustrated by orientation line 150). As shown in FIG. 3A-3C, the raising mechanisms 160 connected to the first structure at one end of the skate park can raise or lower the structure a second distance to decline the skate park at a second angle (also illustrated by orientation line 150). In a more particular example, the raising mechanisms 160 placed at the end of the skate park can be configured to raise or lower ten feet or any other suitable distance for every additional degree of decline.

Alternatively, in some embodiments, the raising or inclining mechanisms 160 can incline or decline one or more structures, such as structures 110 or 120, of the skate park 100. For example, a first set of raising mechanisms can decline a first set of structures of the skate park (e.g., structure 110 that includes a set of stairs) at a first predetermined number of degrees (e.g., three degrees) and a second set of raising mechanisms can incline a second set of structures of the skate park (e.g., structure 120 that includes a ramp) at a second predetermined number of degrees (e.g., ten degrees).

It should be noted that, although the raising or inclining mechanisms are generally described herein as mechanical mechanisms or mechanical devices, this is merely illustrative. Any suitable raising mechanisms can be used, such as, for example, electrical, hydraulic, and/or pneumatic. In a particular example, the raising mechanisms can receive a signal from a computing device to hydraulically hoist the skate park from one end of the skate park about ten feet from the ground, thereby creating an incline or decline of a particular number of degrees. In another particular example, the raising mechanisms can receive a signal from a computing device to hydraulically lower the skate park from one end of the skate park, thereby creating a declined skate park.

In some embodiments, the raising mechanisms configured to incline or decline the skate park can be connected to a computing device or any other suitable processor. For example, the computing device can provide signals or instructions to and generally control raising mechanisms 160 to decline skate park 100 to a particular degree. In another example, a user at the computer device can instruct the computer device to control raising mechanisms 160 to decline skate park 100 to a particular angle.

More particularly, the computing device can be used by an administrator user (e.g., an administrator of skateboarding competition) or a referee user to control the raising mechanisms. For example, the user of the computing device can instruct the raising mechanisms to raise or lower the skate park to create a particular incline angle (e.g., a ten degree downhill course). In another example, the user of the computing device can instruct the raising mechanisms to raise or lower the skate park or a particular structure or portion of the skate park a particular number of degrees.

It should be noted that the computing device implemented in accordance with some embodiments can be a general purpose device, such as a personal computer, a laptop computer, a mainframe computer, a dumb terminal, a data display, an Internet browser, a personal digital assistant (PDA), a two-way pager, a wireless terminal, or a portable telephone, or a special purpose device, such as a server, a portable telephone, a multimedia device, etc. For example, the computing device can be a wireless computing device used by a referee or an administrator to instruct raising mechanisms 160 to lift portions of the course to particular heights creating a particular angle of incline for skate park 100. In a more particular example, the wireless computing device can allow the referee or the administrator to indicate an incline angle (e.g., three degrees) or a gradient or slope (e.g., negative two) and, in response to providing the angle, gradient, or slope, the wireless computing device can calculate the particular heights that each raising mechanism 160 should lift that portion of skate park 100 and instruct raising mechanisms 160 accordingly. In another more particular example, the wireless computing device can allow the referee or the administrator to indicate multiple incline angles and multiple slopes for different portions of skate park 100. In yet another more particular example, the wireless computing device can provide an interface with an up or down option that allows the referee or the administrator to incline or decline skate park 100.

In some embodiments, the computing device can be used by a competitor rider to determine the particular number of degrees for the skate park for use by the opposing team. For example, during a skateboarding competition, a first team may begin by accumulating points with particular skateboarding tricks in the skate park (e.g., at a zero degree incline). As the skateboarding competition continues and prior to the next round beginning, the second team can determine the particular number of degrees to decline the skate park for use by the first team. In response, the first team can then indicate the particular number of degrees to decline the skate park for use by the second team.

In some embodiments, the computing device can be used by a competitor rider to input a gradient for the skate park for use by the competing team. For example, during a skateboarding competition, a competing team can input a gradient (e.g., a particular gradient and a particular tilt) and, in response to inputting a gradient, a particular scoring matrix associated with the gradient can be retrieved and used for scoring a rider's run in the skate park. In a more particular example, each team can have an opportunity to input a gradient to receive a skate park with a particular difficulty and have the opportunity to achieve a particular score.

Figure 4:
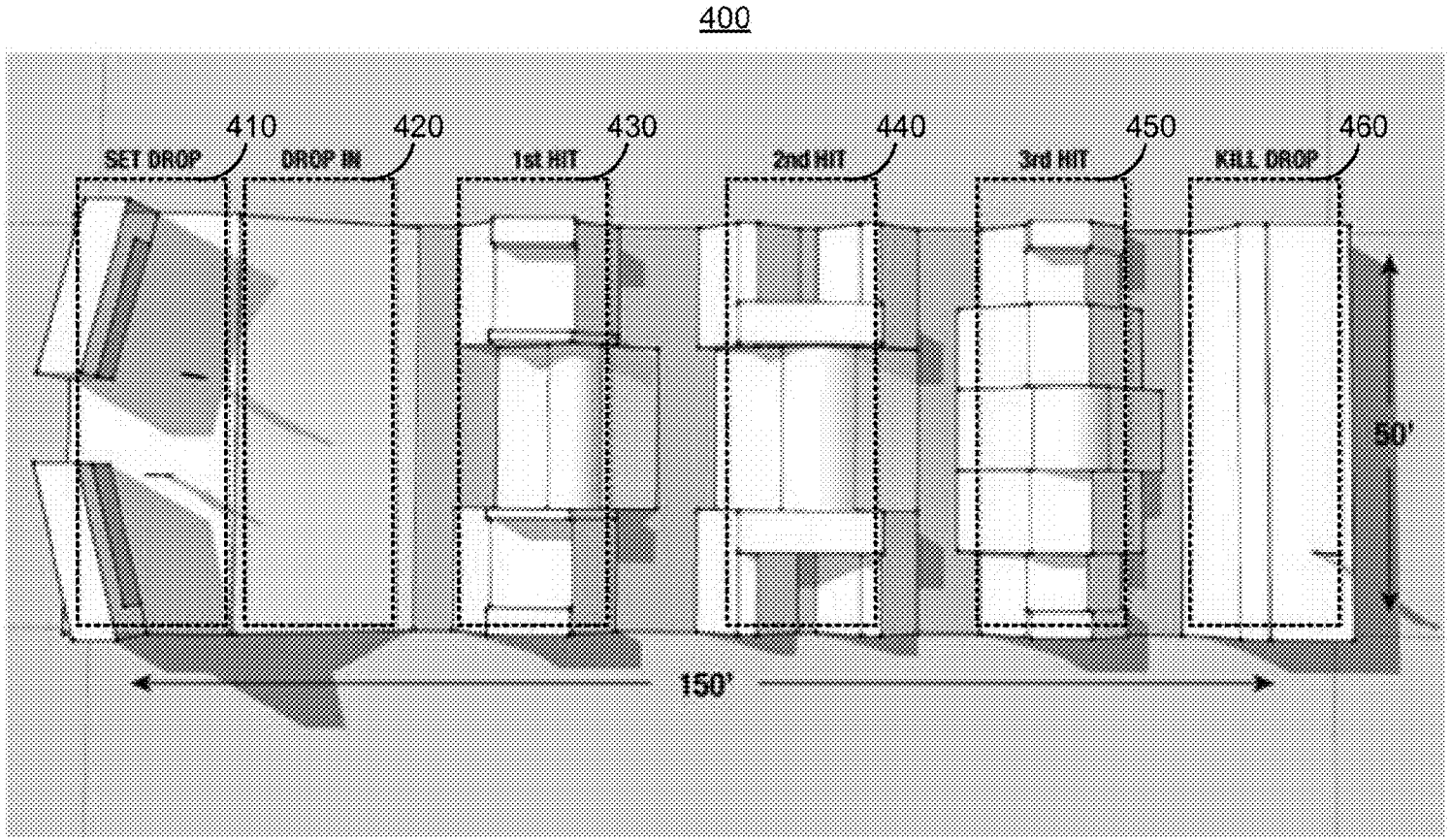
FIG. 4 shows an illustrative example of a skate park system with multiple structures in accordance with some embodiments of the disclosed subject matter.

As described above, the skate park system can include structures, where each of these structures can include one or more features, such as a curb, a ledge, a set of stairs, a handrail, a sidewalk, a driveway bump, a fence, a wall, an embankment, a planter, a bench, a picnic table, a manhole, a pipe, and/or a ramp. Each of these structures can be interconnected to form a skate park 400. For example, as shown in FIG. 4, skate park 400 includes six structures—e.g., set drop structure 410, drop in structure 420, first hit structure 430, second hit structure 440, third hit structure 450, and kill drop structure 460. Each of these structures can be constructed and interconnected at the location of skate park 400.

Figure 5:
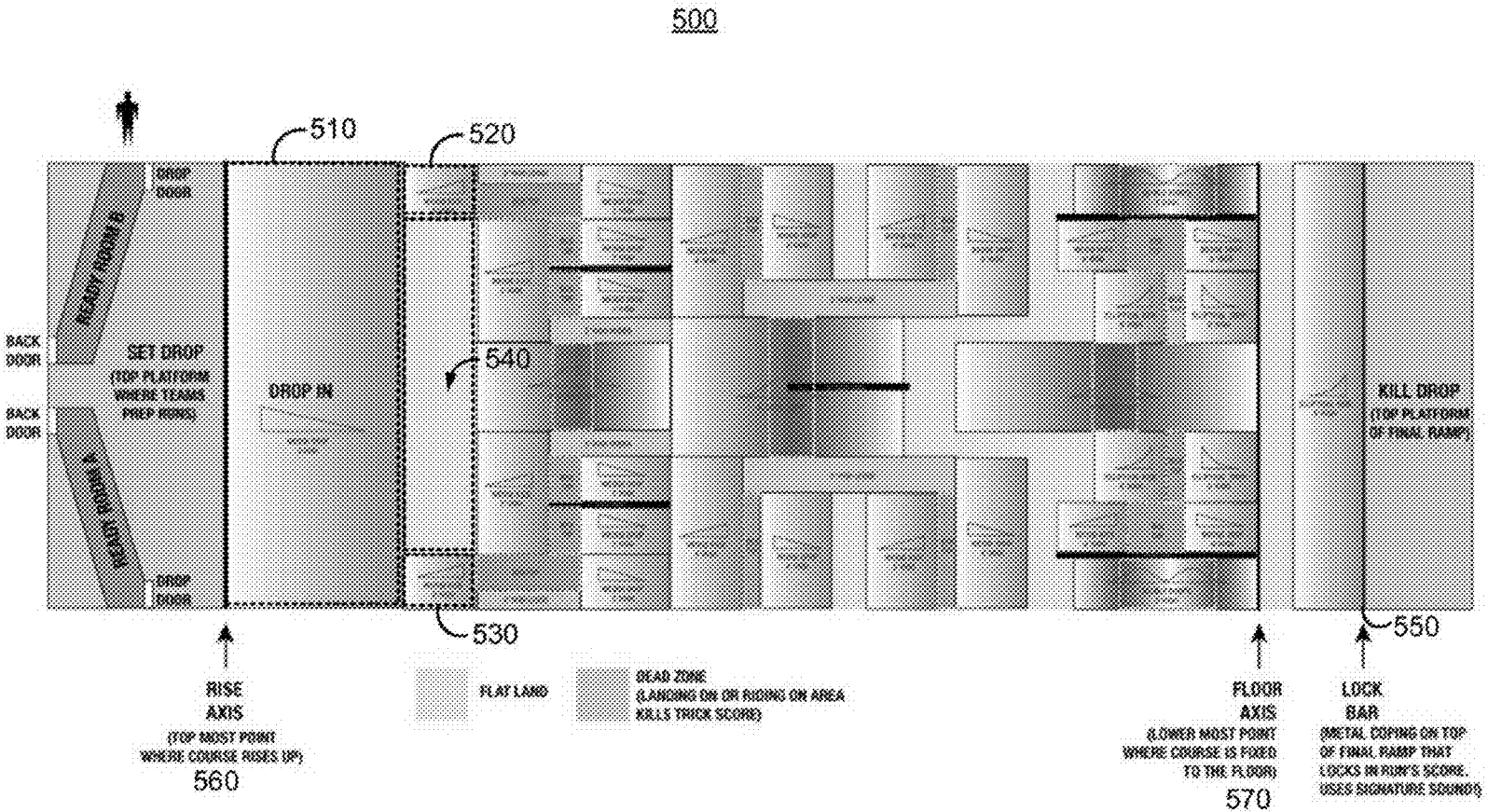
FIG. 5 shows an illustrative example of multiple modular structures interconnected to form a skate park in accordance with some embodiments of the disclosed subject matter.

In some embodiments, each of the structures 410 through 460 can include one or more modular structures, where each individual modular structure or component of one of the structures 410 through 460 (e.g., a three foot high wedge kick, an eight foot high wedge drop, flat areas, bumps, box tops, elliptical kicks, etc.) can be interconnected at the location of skate park. For example, as shown in FIG. 5, a drop-in component 510 can be connected with a ramp component 520, a flat area 530, and a ramp component 540. Any suitable component or structure can be interconnected.

In some embodiments, as also shown in FIG. 5, the skate park can include a lock bar 550. For example, lock bar 550 can be placed at the end portion of the skate park before the final platform. Alternatively, lock bar 550 can be placed after the last section of the skate park. In yet another example, lock bar 550 can be arranged as the coping on the end of the quarter pipe shown in FIG. 5. In response to a rider contacting lock bar 550 during a competition, a signal can be played and the score for that rider is locked and protected for a particular round such that no additional points or scores can be obtained by the rider. However, lock bar 550 can be used for any other suitable scoring approach. For example, a rider and/or a competitive team of riders can obtain bonus points upon activating lock bar 550. In a more particular example, a competitive skateboarding format can include multiple quarters, where lock bar 550 is associated with a particular response for each quarter:

| Quarter | Bonus Point |
|---|---|
| First Quarter | Lock the current score for a rider |
| Second Quarter | Bonus points for final hit on the quarter pipe or ending structure |
| Third Quarter | Bonus points for final hit on the quarter pipe or ending structure. However, the rider is to voluntarily end the run such that a fall or a bail can nullifies any bonus points. |
| Fourth Quarter | Bonus points for final hit on the quarter pipe or ending structure. However, the rider is to voluntarily end the run such that a fall or a bail nullifies all points accumulated from the run and any bonus points. |

In addition, FIG. 5 includes a rise axis 560 and a floor axis 570 that represent the top most point where the skate park rises up and the lowest point where the skate park is fixed to the ground, respectively. As described above, in some embodiments, the skate park can include various points that are inclined and can include various points that are fixed to the ground. Alternatively, the entire skate park can be inclined on an elevated platform, where rise axis 560 is the highest or top most point of the skate park and the floor axis 570 is the lowest portion of the skate park.

In a more particular embodiment, when the skate park is composed of modular structures and/or modular components, the modular skate park can be configured such that it can be installed in a pre-existing arena or stadium (e.g., a basketball arena, a football stadium, a hockey rink, etc.). For example, in addition to the structures being capable of interconnecting with each other using a suitable interlocking mechanism, the structures can be adapted to connect to the structures associated with a hockey rink.

As described above, the casual viewer of a skateboarding competition generally does not understand the subjective scoring system that one or more judges award to particular riders. This inhibits the spectator from knowing if certain riders need a particular score during a skateboarding competition. This lack of understanding does not help to create excitement during the competition.

In addition, the rider has little understanding as to scoring that can be achieved for performing particular tricks or combinations of tricks. This generally inhibits a rider from understanding exactly what level of skating that rider needs to put forth to win the event (e.g., a particular trick or sequence of tricks, a particular difficulty level, etc.). Moreover, in typical skateboarding competitions, riders tend to perform tricks to his or her strengths and/or capabilities. For example, a rider that is not known to ride switch-stance performs a trick or a combination of tricks riding switch-stance and, as a result, the one or more judges acknowledge this and award a higher score to the rider than if the rider performed the trick riding in a regular stance. This too is lost on the spectator.

Accordingly, there is a need for a competition format that can be carried out in the inclinable skate park with one or more rules to guide the competition. There is also a need for a scoring approach for such a competition format.

Figure 6:
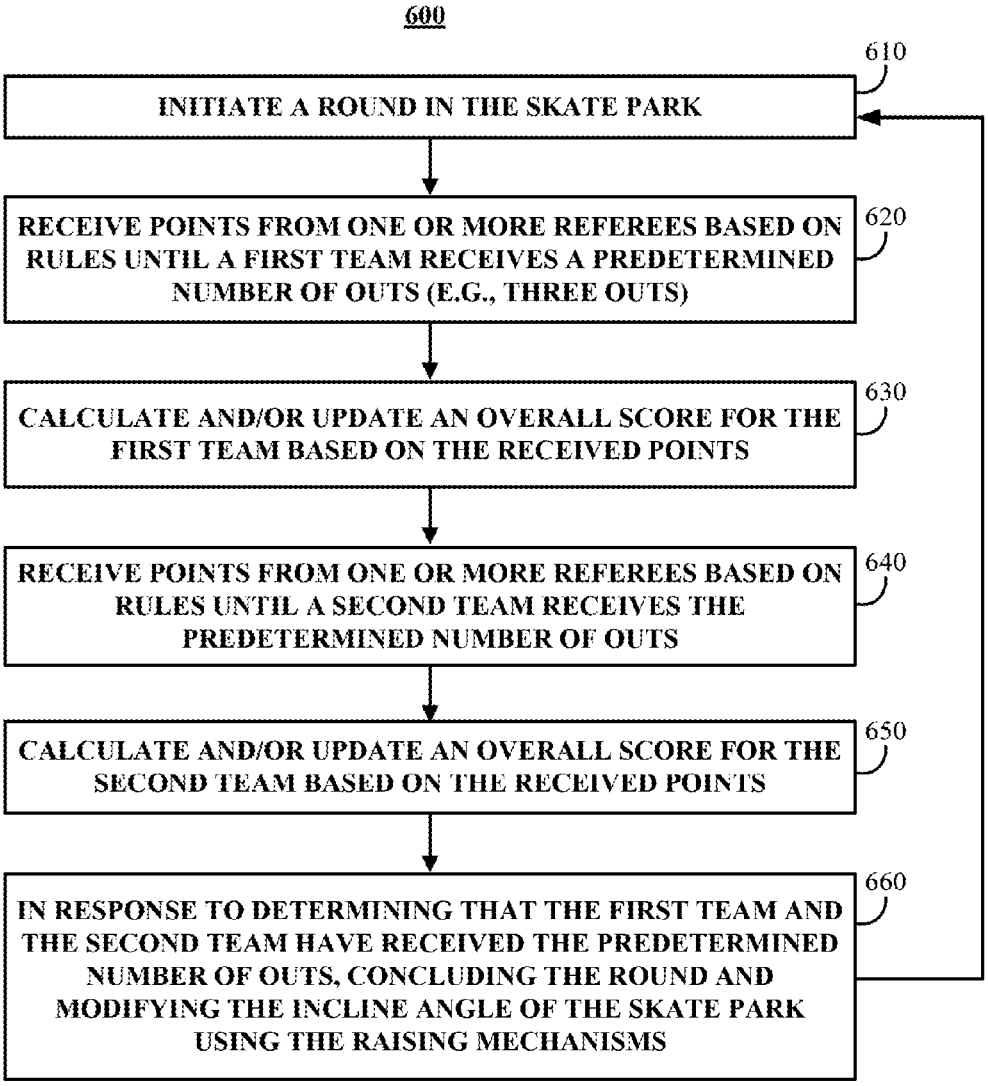
FIG. 6 shows an illustrative flowchart for scoring skateboarding competitions in the skate park shown in FIGS. 1A-5 in accordance with some embodiments of the disclosed subject matter.

FIG. 6 shows an illustrative scoring method 600 for a skateboard competition using the inclinable skate park system shown in FIGS. 1A-5 in accordance with some embodiments of the disclosed subject matter.

As shown in FIG. 6, the scoring method 600 begins by initiating a round of the skateboarding competition in the skate park at 610. The competition format can include any suitable number of teams. In one particular example, a home team competes against an opposing team for four quarters with each quarter including three rounds (or twelve rounds total).

At 620, an objective scoring approach can be provided. For example, as shown in the park of FIG. 1A-5, one referee can be assigned to monitor the left side of the park, one referee can be assigned to monitor the right side of the park, and one referee can be assigned to monitor the park from the top of the end ramp. In response to performing particular skateboarding tricks, each referee can use a wireless computing device or any other suitable approach for awarding points. For example, in response to performing a safety or safely rolling over an obstacle a given number of times, one point may be awarded to the rider. In another example, multiple points may be awarded in response to performing a combination of tricks (e.g., a frontside 180 ollie to a grind to a switch kickflip). In yet another suitable example, particular multipliers can be awarded for riding switch-stance (if the switch stance is not the primarily used stance), particular combinations, etc. It should be noted that multiple referees can be used to assign points (e.g., for completing a trick or a sequence of tricks), assess penalties (e.g., for falling, for stepping off the skateboard, for a toe drag, etc.), assess bonus points (e.g., performing a trick of substantial difficulty).

Each team in each round can accumulate points by performing tricks on one or more sections (that include at least one of the above-mentioned structures or features) until reaching a particular number of falls or bails. In addition, in some embodiments, each rider can be prohibited from placing a foot off the skateboard and onto the ground of the skate park. For example, a scoring approach can be implemented as follows:

| Trick | Points |
|---|---|
| 180 degree rotation | 1 point-per rotation (e.g., 2 points for a 360 degree rotation) |
| Kick/heel flip | 1 point-per flip (e.g., 2 points for a double flip) |

-continued

| Trick | Points |
|---|---|
| Treflips | 2 points |
| Nollie | 2 points |
| 50/50 | 1 point |
| 5-0/nose grind | 2 points |
| Tail/nose/board slide | 1 point |
| Smith/Crooks/Blunts | 2 points |
| Grab | 1 point |
| Vintage trick | 1 point |
| Craze | 3 points |
| Switch | Double (2×) |

In response to receiving points from one or more referees, an overall score for the first team can be calculated and/or updated at 630. For example, a computing device can calculate the overall score for the first team and provide a real-time display of the overall score.

As the rider performs during a round, points can be accumulated by the rider and displayed in the skate park. Accordingly, the rider, the rider's team, and/or the rider's coach can alter strategies (e.g., perform a combination of tricks of a particular difficulty level, substitute a rider, call a timeout, etc.) based on the real-time score.

At 640, upon reaching the particular number of falls (e.g., three falls), the opposing team begins its opportunity to accumulate points. As points are accumulated during the round, an overall score for the first team can be calculated and/or updated at 650. For example, the computing device can calculate the overall score for the second team and provide a real-time display of the overall score.

When the opposing team reaches the particular number of falls, a round is concluded. As described above, between each round, the incline of the skate park can be raised or lowered by a given number of degrees (e.g., two degrees) at 660. This can be performed by any suitable raising mechanisms (e.g., mechanical raising mechanisms, scissor lifts, electrical lifts, etc.). As shown in FIG. 5, the raising mechanisms can be placed beneath portions of the skate park between a rise axis at the topmost raised portion of the skate park and a floor axis affixed to the ground. In one example, one end of the skate park can be raised using raising mechanisms to create a downhill skate park. In another example, one end of the skate park can be lowered using raising mechanisms to create a downhill skate park.

As a result, the competitive format can dynamically change with every round, where the course gets steeper and faster, thereby allowing and/or requiring different tricks and combinations, increasing difficulty level, changing strategy, etc. For example, a coach or advisor of a team can determine that one particular player is better suited for performing skateboarding tricks on a flat course, while another player can use the speed from the inclined skate park to perform tricks of greater difficulty.

As described above, in some embodiments, the skate park may be composed of one or more modular structures and/or modular components. Between each round, the modular structures of the skate park can be replaced with alternate modular structures. For example, particular modular structures (e.g., a ramp and a set of stairs) can be replaced with other modular structures (e.g., a planter and a half pipe). In another example, to not provide an advantage to any particular rider, a skate park can be assembled that integrates modular structures and features from one environment (e.g., concrete stairs) and, prior to starting the next round, the modular structures and features can be replaced with those simulating another environment (e.g., wooden half pipes).

In most embodiments, the methods of the present application, such as the scoring approach or the approach for inclining the skate park, will be implemented on machines that are programmed according to the techniques described with respect to the embodiments for carrying out the functional features of the methods. Such machines include, but are not limited to, general purpose computers, special purpose computers, etc. For example, user computers and/or servers implemented in accordance with some embodiments can be a general purpose device, such as a personal computer, a laptop computer, a mainframe computer, a dumb terminal, a data display, an Internet browser, a personal digital assistant (PDA), a two-way pager, a wireless terminal, or a portable telephone, or a special purpose device, such as a server, a portable telephone, a multimedia device, etc. The server can be any suitable server for executing the application, such as a processor, a computer, a data processing device, or a combination of such devices. For example, the server can be a general purpose device, such as a computer, or a special purpose device, such as a client, a server, a multimedia server, etc. Any of these general purpose or special purpose devices can include any suitable components such as a processor (which can be a microprocessor, a digital signal processor, a controller, etc.), memory, communication interfaces, display controllers, input devices, etc. It should be noted that any reference to a general purpose computer are meant to be directed to a device programmed as described herein.

In some embodiments, any suitable computer readable media can be used for storing instructions for performing the processes described herein. For example, in some embodiments, computer readable media can be transitory or non-transitory. For example, non-transitory computer readable media can include media such as magnetic media (such as hard disks, floppy disks, etc.), optical media (such as compact discs, digital video discs, Blu-ray discs, etc.), semiconductor media (such as flash memory, electrically programmable read only memory (EPROM), electrically erasable programmable read only memory (EEPROM), etc.), any suitable media that is not fleeting or devoid of any semblance of permanence during transmission, and/or any suitable tangible media. As another example, transitory computer readable media can include signals on networks, in wires, conductors, optical fibers, circuits, any suitable media that is fleeting and devoid of any semblance of permanence during transmission, and/or any suitable intangible media.

It should be understood that the above steps of the flow diagram of FIG. 6 may be executed or performed in any order or sequence not limited to the order and sequence shown and described in the figure. Also, some of the above steps of the flow diagram of FIG. 6 may be executed or performed substantially simultaneously where appropriate or in parallel to reduce latency and processing times.

Accordingly, an inclinable skate park system and methods for using the same are provided.

Although the present invention has been described and illustrated in the foregoing exemplary embodiments, it is understood that the present disclosure has been made only by way of example, and that numerous changes in the details of implementation of the invention may be made without departing from the spirit and scope of the invention. Features of the disclosed embodiments can be combined and rearranged in various ways.

What is claimed is:

1. A skate park system, the system comprising:

a plurality of skateboarding structures, wherein each structure of the plurality of skateboarding structures includes one or more features for allowing a human skateboarder to perform at least one skateboarding trick and wherein the plurality of skateboarding structures are connected together to form a skate park having opposing ends;

a plurality of mechanical lifts connected to a bottom portion of one of the opposing ends of the skate park, wherein the plurality of mechanical lifts are positioned beneath at least a portion of the plurality of skateboarding structures; and a processor connected to the plurality of mechanical lifts that is configured to:

detect that a round of a skateboarding event has been completed; and in response to detecting that the round of the skateboarding event has been completed, control the plurality of mechanical lifts positioned at the bottom portion of one of the opposing ends of the skate park to raise from a first position to a second position, thereby causing the plurality of skateboarding structures to adjust from a first incline angle to a second incline angle.

2. The skate park system of claim 1, wherein the one or more features include at least one of: curbs, ledges, sets of stairs, handrails, sidewalks, driveway bumps, fences, walls, embankments, planters, benches, picnic tables, manholes, pipes, and ramps.

3. The skate park system of claim 1, wherein the plurality of mechanical lifts are a plurality of mechanical scissor-type lifts for raising or lowering the opposing end of the skate park.

4. The skate park system of claim 1, wherein the plurality of mechanical lifts are a plurality of hydraulic lifts for raising or lowering the opposing end of the skate park.

5. The skate park system of claim 1, wherein the plurality of mechanical lifts are a plurality of electrical lifts for raising or lowering the opposing end of the skate park.

6. The skate park system of claim 1, wherein the plurality of mechanical lifts are coupled beneath a first portion of the plurality of skateboarding structures and beneath a second portion of the plurality of skateboarding structures and wherein the processor is further configured to decline the first portion of the plurality of skateboarding structures by a third incline angle and decline the second portion of the plurality of structures by a fourth incline angle.

7. The skate park system of claim 1, wherein the processor is configured to:

control the plurality of mechanical lifts to raise from the first position to the second position, thereby causing an incline angle associated with the plurality of skateboarding structures to be adjusted from the first incline angle to the second incline angle for a first period of time; and modify the second incline angle of the plurality of skateboarding structures to a third incline angle by controlling the plurality of raising mechanisms to raise to a third position for a second period of time.

8. The skate park system of claim 1, wherein the processor is configured to:

receive an indication that the skateboarder has performed at least one skateboarding trick;

determine a score for the at least one skateboarding trick based on one or more scoring rules; and calculate a real-time overall score associated with the skateboarder for a round.

9. The skate park system of claim 1, wherein each skateboarding structure is a modular structure that is interchangeably connected to another modular structure of the plurality of skateboarding structures.

10. The skate park system of claim 9, wherein at least one of the plurality of skateboarding structures is the modular structure that is replaced with an alternative modular structure.

11. The skate park system of claim 1, further comprising a real-time scoring display that provides the real-time overall score calculated using the processor.

* * * * *